US012220092B2

(12) United States Patent
Kim

(10) Patent No.: US 12,220,092 B2
(45) Date of Patent: Feb. 11, 2025

(54) TOILET COVER CAPABLE OF CHECKING INSIDE AND TOILET RESIDUE ALARM APPARATUS

(71) Applicant: Dong Wook Kim, Uijeongbu-si (KR)

(72) Inventor: Dong Wook Kim, Uijeongbu-si (KR)

( * ) Notice: Subject to any disclaimer, the term of this patent is extended or adjusted under 35 U.S.C. 154(b) by 84 days.

(21) Appl. No.: 18/028,223

(22) PCT Filed: Oct. 12, 2021

(86) PCT No.: PCT/KR2021/014000
§ 371 (c)(1),
(2) Date: Mar. 24, 2023

(87) PCT Pub. No.: WO2022/086016
PCT Pub. Date: Apr. 28, 2022

(65) Prior Publication Data

US 2023/0371762 A1 Nov. 23, 2023

(30) Foreign Application Priority Data

Oct. 23, 2020 (KR) ..... 10-2020-0138073

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/242.1
See application file for complete search history.

(56) References Cited

U.S. PATENT DOCUMENTS

2005/0120469 A1* 6/2005 Benkhardt ..... A47K 13/24 4/242.1
2006/0272079 A1* 12/2006 Moreda Alegria .... A47K 13/24 4/234
2007/0169255 A1* 7/2007 Benkhardt ..... A47K 13/24 4/234
2020/0299946 A1* 9/2020 Lee ..... A47K 13/24

FOREIGN PATENT DOCUMENTS

JP 2004-065542 A 3/2004
JP 2017-104363 A 6/2017
KR 10-1790331 B1 10/2017
KR 10-2018-0067804 A 6/2018

OTHER PUBLICATIONS

International Search Report for PCT/KR2021/014000 mailed Jan. 5, 2022 from Korean Intellectual Property Office.

* cited by examiner

*Primary Examiner* — Huyen D Le
(74) *Attorney, Agent, or Firm* — Revolution IP, PLLC

(57) ABSTRACT

The present disclosure provides a toilet cover allowing an inside of a toilet, which includes a toilet seat and the toilet cover, to be checked and having one end fixed to an upper portion of the toilet by a steel hinge to be able to be opened and closed by rotation, the toilet cover including: at least one transparent hole of a first transparent hole which is a through-hole with a predetermined diameter that is filled with a transparent material and includes a convex lens therein and a second transparent hole which is a through-hole with a predetermined diameter that is filled with a transparent material and includes a concave lens therein; and a colored cellophane sheet configured to cover the at least one transparent hole.

6 Claims, 4 Drawing Sheets

[FIG. 1]
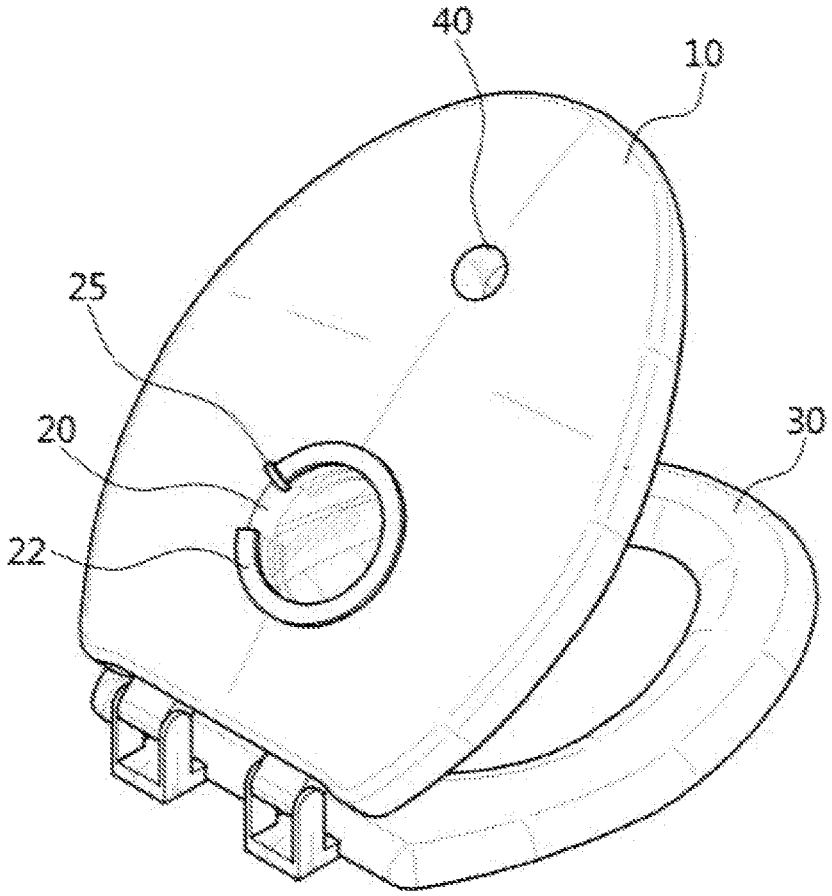

[FIG. 2]
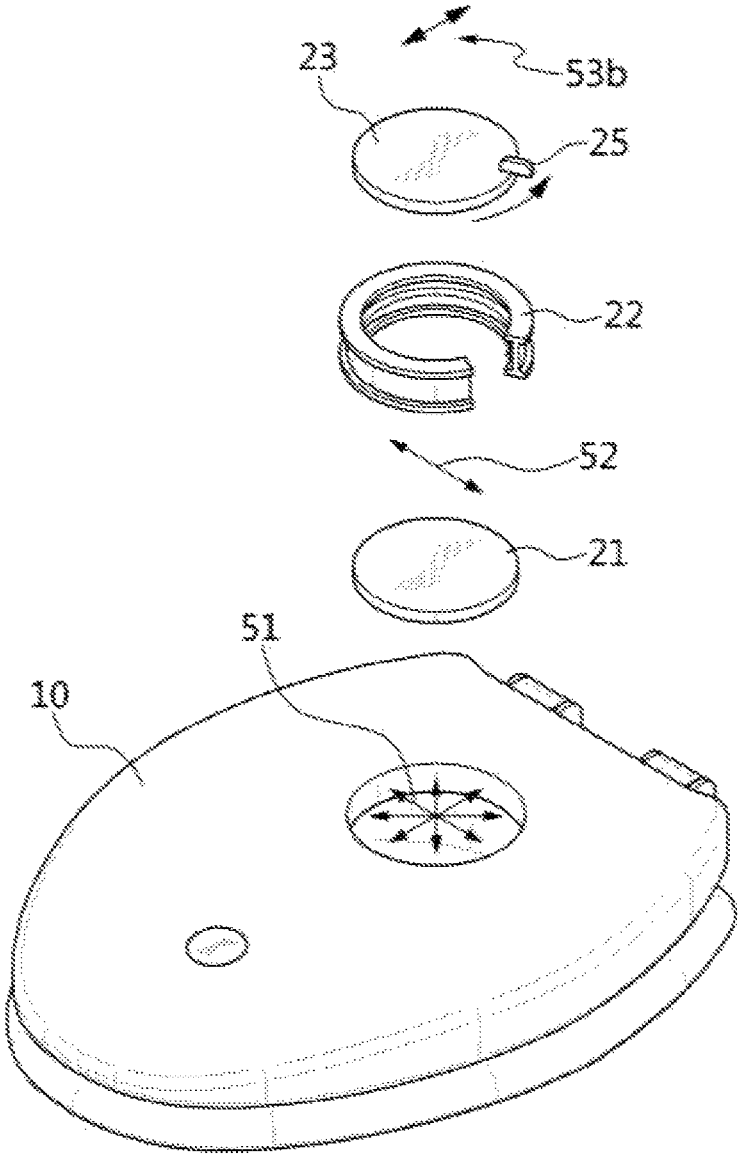

[FIG. 3]
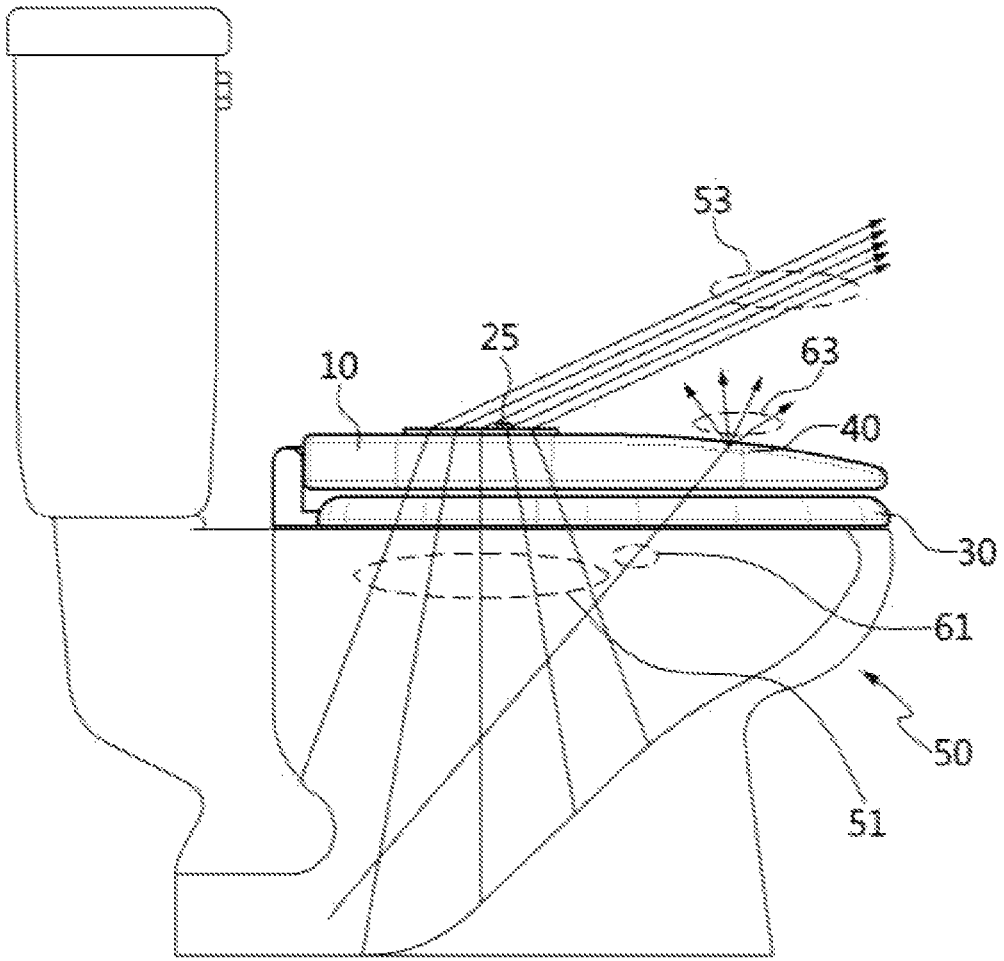
[FIG. 4]
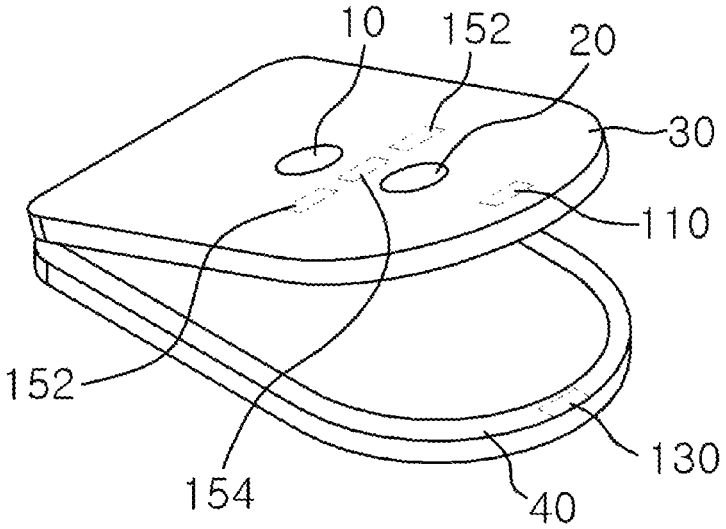

[FIG. 5]
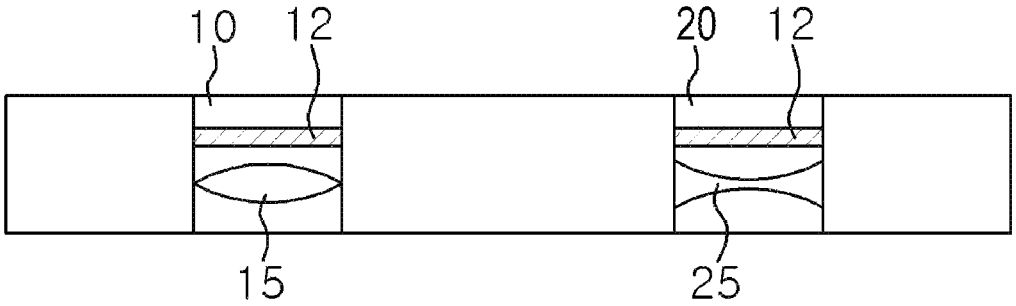
[FIG. 6]
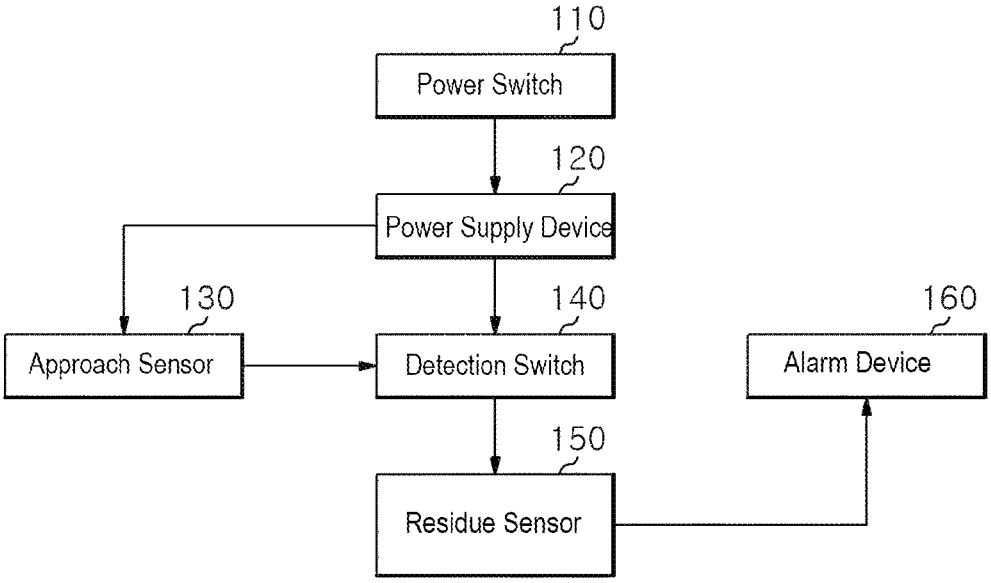

TOILET COVER CAPABLE OF CHECKING INSIDE AND TOILET RESIDUE ALARM APPARATUS

CROSS REFERENCE TO PRIOR APPLICATIONS

This application is the 35 U.S.C. 371 national stage of international application PCT/KR2021/014000 filed on Oct. 12, 2021 which claims priority to Korean Patent Application No. 10-2020-0138073 filed on Oct. 23, 2020. The entire contents of each of the above-identified applications are hereby incorporated by reference.

TECHNICAL FIELD

The present disclosure relates to a toilet cover allowing an inside of a toilet to be checked and a toilet residue alarm apparatus, and more particularly, to a toilet cover allowing an inside of a toilet to be checked which allows content in the toilet to be checked in a state in which the toilet cover is closed and a toilet residue alarm apparatus which provides an alarm to a user in a case in which residue is present inside the toilet.

BACKGROUND ART

A toilet cover is a lid that is provided together with a toilet seat, attached to an edge of the toilet seat by a steel hinge, and closed when a Western-style toilet is not in use, thus preventing water from splashing onto the toilet seat while making the inside of the toilet invisible.

In the past, many technologies relating to toilet covers, such as a technology to improve convenience of opening and closing a toilet cover, a technology to allow the size of a toilet seat to be adjusted for use by both adults and children, and a technology to make a toilet seat warm even in the winter, have been developed.

However, the greatest inconvenience experienced by users in relation to toilet covers in reality is that, when a toilet cover of a toilet is closed before use of the toilet or when cleaning the toilet, it is not possible to check whether excreta or vomit remains in the toilet. Since others' excreta or vomit may be very disgusting, a user may experience great stress when opening a toilet cover in a state in which whether excreta remains in a toilet cannot be checked, and since not only is it disgusting to see, but also the smell is unpleasant, a squeamish person may experience extreme stress that may cause that person to vomit.

Accordingly, a need for a method that allows whether excreta or vomit remains in a toilet to be checked without opening a toilet cover has come to the fore, and Korean Patent Registration No. 10-1790331 (Date of Registration: Oct. 19, 2017), which is referenced as a related art document in this specification as a way of addressing the need, has been proposed.

In the above publicized patent, as illustrated in FIG. 1 (FIG. 1 of the referenced document) and FIG. 2 (FIG. 8 of the referenced document), there is disclosed a toilet including a seat plate 30 which is coupled to an opening of the toilet so as to be rotatable in a front-rear direction and a toilet cover 10 which is hinge-coupled to a rear of an upper surface of the seat plate 30 so as to open or close the opening of the toilet, wherein the toilet cover 10 includes a first through-hole 20 which is formed in the toilet cover 10 to allow an inside of the toilet to be checked by visual inspection, a second through-hole 40 which is formed in the toilet cover 10 and disposed in front of the first through-hole 20, a support member 22 which is coupled to the first through-hole 20 and has an opening open to allow the inside of the toilet to be checked by visual inspection and two grooves formed along an inner wall of the opening, a first polarizing lens 21 which is installed in any one of the two grooves of the support member 22, and a second polarizing lens 23 which is installed in the other groove of the support member 22 so as to be rotatable in a left-right direction and has a polarization axis disposed in bilateral symmetry with a polarization axis of the first polarizing lens 21.

By the toilet cover, since the first polarizing lens 21 and the second polarizing lens 23 whose polarization axes are in bilateral symmetry are provided, and the second polarizing lens 23 is rotated to make content inside the toilet easy to see or hard to see, whether excreta or vomit remains inside the toilet can be checked without opening the toilet cover as necessary.

Also, in the above publicized patent, as illustrated in FIG. 3 (FIG. 9 of the referenced document), there is disclosed a configuration in which the toilet cover 10 further includes a lamp installed at a bottom surface of the toilet cover 10 to radiate light toward the inside of the toilet, a sensor installed at a front surface of the toilet cover to detect approach of a user, and a controller configured to operate the lamp in response to the sensor detecting the approach of the user.

By the above configuration, using the lamp, the sensor, and the controller, the lamp is operated in a case in which the user approaches close to the toilet, thus illuminating the inside of the toilet to make excreta or vomit inside the toilet easy to see.

However, in the above related art, there is an inconvenience that the user has to operate a rotary handle at an upper end of the toilet in order to check the content inside the toilet. That is, in a case in which a previous user does not move the second polarizing lens to a position that makes the inside of the toilet invisible, the inside of the toilet is visible at all times, and thus it is not highly necessary to change between a state in which the inside of the toilet is visible and a state in which the inside of the toilet is invisible, and in a case in which a previous user operates the handle to an extent that the inside of the toilet is invisible, the previous user may be considerate enough to empty the toilet of its content, and thus there is no need to manufacture the toilet cover with a complex structure that includes a plurality of polarizing lenses whose polarization axes are different.

Also, according to the above related art, there is a problem that, since excreta or vomit inside the toilet is visible as it is, it may be very disgusting to see.

DISCLOSURE

Technical Problem

The present disclosure is directed to providing a toilet cover that allows whether a residue is present inside a toilet to be checked without opening the toilet cover or performing an additional operation.

The present disclosure is directed to providing a toilet cover that allows, in a case in which a residue is present inside a toilet, the residue in the toilet to be checked with less disgust in terms of sight.

The present disclosure is directed to providing a toilet residue alarm apparatus which provides an alarm to a user visually and/or aurally in a case in which a residue is present in the toilet, thus preventing the user from feeling disgust or discomfort in terms of sight and/or smell and allowing the user to be aware that the residue is present in the toilet.

Technical Solution

One exemplary embodiment of the present disclosure provides a toilet cover allowing an inside of a toilet, which includes a toilet seat and the toilet cover, to be checked and having one end fixed to an upper portion of the toilet by a steel hinge to be able to be opened and closed by rotation, the toilet cover including: at least one transparent hole of a first transparent hole which is a through-hole with a predetermined diameter that is filled with a transparent material and includes a convex lens therein and a second transparent hole which is a through-hole with a predetermined diameter that is filled with a transparent material and includes a concave lens therein; and a colored cellophane sheet configured to cover the at least one transparent hole.

In the above embodiment, the first transparent hole may be positioned at a vertical upper end of a drain hole of the toilet, and the second transparent hole may be positioned at a center of the toilet cover.

In the above embodiment, the toilet cover allowing the inside of the toilet to be checked may use, in place of the colored cellophane sheet, a colored transparent material obtained by dyeing the transparent material a predetermined color.

Another exemplary embodiment of the present disclosure provides a toilet residue alarm apparatus provided at a toilet cover to alert the presence of a residue in a toilet, the toilet residue alarm apparatus including: an approach sensor configured to detect an approach of a person; a residue sensor configured to, in response to the approach of the person being detected by the approach sensor, detect whether a residue is present in the toilet; and an alarm device configured to, in response to the residue being detected by the residue sensor, alert the presence of the residue by turning on light or generating an alarm sound.

In the above embodiment, the toilet residue alarm apparatus may further include a power switch provided at a leading end of the toilet cover to allow the toilet residue alarm apparatus to operate only in a state in which the toilet cover is placed on and closing the toilet.

In the above embodiment, the power switch may be a push button switch.

In the above embodiment, the toilet residue alarm apparatus may further include: a power supply device configured to supply power in response to the power switch being turned on; and a detection switch configured to block power supplied from the power supply device to the residue sensor and be turned on and supply the power from the power supply device to the residue sensor only in a case in which an approach detection signal is generated by the approach sensor.

Advantageous Effects

According to the present disclosure, there is an advantageous effect that whether a residue is present in a toilet can be checked through a transparent hole of a toilet cover without opening the toilet cover or performing an additional operation.

According to the present disclosure, there is an advantageous effect that the inside of the toilet can be checked as a whole through a concave lens attached to a transparent hole of the toilet cover.

According to the present disclosure, there is an advantageous effect that the inside of the toilet can be magnified and checked in detail through a convex lens attached to a transparent hole of the toilet cover.

According to the present disclosure, there is an advantageous effect that, by using a colored transparent hole coated with a specific color or a colored cellophane sheet attached to a transparent hole in a toilet cover, and changing the color of a residue present inside a toilet, disgust towards seeing the corresponding residue can be reduced.

According to the present disclosure, there is an advantageous effect that, in a case in which a residue is present inside a toilet, by detecting the residue and providing an alarm to a user visually and/or aurally, the user can be aware of the disgusting matter inside the toilet without directly checking the inside of the toilet.

DESCRIPTION OF DRAWINGS

Prior to describing embodiments of the present disclosure in more detail using the drawings, it should be noted that the same components and components having the same functions and/or the same technical or physical effects are identified by assigning the same reference numerals thereto or using the same names, and components illustrated or described in different embodiments and descriptions of functions thereof may be interchangeable between each other or interchangeably applied in different embodiments.

FIG. 1 is a perspective view of a toilet cover that corresponds to FIG. 1 of the referenced document.

FIG. 2 is a view for describing components of the toilet cover that corresponds to FIG. 8 of the referenced document.

FIG. 3 is a view illustrating an embodiment of the toilet cover that corresponds to FIG. 9 of the referenced document.

FIG. 4 is a perspective view of a toilet cover according to one exemplary embodiment of the present disclosure.

FIG. 5 is a detailed configuration diagram illustrating configurations of a first transparent hole including a convex lens and a second transparent hole including a concave lens, which are transparent holes of the toilet cover according to one exemplary embodiment of the present disclosure.

FIG. 6 is a block diagram of a toilet residue alarm apparatus according to one exemplary embodiment of the present disclosure.

MODES OF THE INVENTION

Since various modifications may be made to the present disclosure and the present disclosure may have various embodiments, particular embodiments are illustrated in the drawings, and the present disclosure will be described in more detail with reference to the drawings.

However, it is not intended to limit the present disclosure to the particular embodiments described below, and all modifications, equivalents, and substitutes included in the spirit and technical scope of the present disclosure should be construed as belonging to the present disclosure.

For terms used in the present disclosure, general terms that are currently widely used have been selected wherever possible while considering functions in the present disclosure, but the terms may vary according to intentions of those of ordinary skill in the art, precedents, the emergence of new technologies, and the like.

Also, in particular cases, some terms may have been arbitrarily chosen by the applicant, and in such cases, the meaning of the terms will be described in detail in the corresponding part of the description of the disclosure.

Unless otherwise defined, all terms including technical or scientific terms used herein have the same meaning as commonly understood by those of ordinary skill in the art to which the disclosure pertains. Terms, such as those defined in commonly used dictionaries, should be construed as having a meaning that is consistent with their meaning in the context of the relevant art and are not to be construed in an idealized or overly formal sense unless expressly so defined herein.

Therefore, the terms used in the present disclosure should be defined on the basis of the meaning of the terms and the content throughout the present disclosure, instead of being defined simply on the basis of the names of the terms.

In the application, terms such as "include" or "have" should be understood as indicating the presence of features, numbers, steps, operations, components, parts, or combinations thereof and not excluding the possibility of the presence or addition of one or more other features, numbers, steps, operations, components, parts, or combinations thereof in advance.

Also, terms such as "device" and "module" used herein refer to a unit of processing at least one function or operation, and the unit may be implemented using hardware or software or may be implemented by a combination of hardware and software.

Terms including ordinals such as "first" and "second" may be used to describe various components, but the terms are only used for the purpose of distinguishing one component from another component, and the components are not limited by the term "first," "second," or the like. For example, a first component may be referred to as a second component, and likewise, a second component may be referred to as a first component without departing from the scope of rights of the present disclosure.

The term "and/or" includes a combination of a plurality of associated listed items or any one item among the plurality of associated listed items. That is, the term "and/or" may simultaneously correspond to both items or correspond to only one of the two items.

When it is mentioned that a certain component is "connected" or "linked" to another component, although the certain component may be directly connected or linked to the other component, it should be understood that another component may be present therebetween. On the other hand, when it is mentioned that a certain component is "directly connected" or "directly linked" to another component, it should be understood that other components are not present therebetween.

Hereinafter, a toilet cover allowing an inside of a toilet to be checked according to one exemplary embodiment of the present disclosure will be described in more detail with reference to FIGS. 4 and 5.

FIG. 4 is a perspective view of a toilet cover according to one exemplary embodiment of the present disclosure, and FIG. 5 is a detailed configuration diagram illustrating configurations of a first transparent hole including a convex lens and a second transparent hole including a concave lens, which are transparent holes of the toilet cover according to one exemplary embodiment of the present disclosure.

First, referring to FIG. 4, in the present embodiment, for convenience of description, a configuration in which a first transparent hole 10 including a convex lens 15 and a second transparent hole 20 including a concave lens 25 are simultaneously provided in a toilet cover 30 will be described as an example. However, it should be noted that, in another embodiment of the present disclosure, a configuration in which only the first transparent hole 10 including the convex lens 15 is formed in the toilet cover 30 and a configuration in which only the second transparent hole 20 including the concave lens 25 is formed in the toilet cover 30 are both possible according to a user's choice. That is, in the present disclosure, the configuration in which only the first transparent hole 10 including the convex lens 15 is formed in the toilet cover 30, the configuration in which only the second transparent hole 20 including the concave lens 25 is formed in the toilet cover 30, and the configuration in which the first transparent hole 10 including the convex lens 15 and the second transparent hole 20 including the concave lens 25 are both formed in the toilet cover 30 are all possible.

Also, the first transparent hole 10 and the second transparent hole 20 may each be formed to have a diameter in a range of 2 cm to 5 cm, but the diameter may be formed larger or smaller according to various factors such as the structure of a toilet and a toilet cover to which the first transparent hole 10 and the second transparent hole 20 are applied, trends, a user's preferences, convenience of manufacturing, and the like.

A power switch 110, a light source 152, and a light receiver 154 which are indicated by dotted lines in FIG. 4 are illustrated as being provided at an inner side of the toilet cover 30, and an approach sensor 130 also indicated by dotted lines is illustrated as being embedded in a front of a toilet seat 40. Specific configurations and functions thereof will be described below.

Also, the toilet cover 30 and the toilet seat 40, which are configurations of the present disclosure, may be applied to the conventional general toilet covers that are currently in use, and in order to more clearly distinguish distinct configurations of the present disclosure, description of configurations of general toilet covers and toilet seats, for example, configurations such as materials, connection structures, shapes, and the like, will be omitted.

Referring to FIG. 5, the first transparent hole 10 according to one exemplary embodiment of the present disclosure is formed by penetrating the toilet cover 30, then filled with a material that is easily moldable and transparent, such as transparent acrylic and transparent polycarbonate, and includes a colored cellophane sheet 12 and the convex lens 15 therein. Here, the colored cellophane sheet 12 is for filtering color in order to reduce disgust in terms of sight in a case in which a residue, such as excreta or vomit, is present inside the toilet, and thus the colored cellophane sheet 12 may be provided to be attached onto the transparent material, inserted into a middle of the transparent material, or provided to be attached to a lower portion of the transparent material, or color may be added to the transparent material itself to form a colored transparent hole. That is, any configuration may be applied as long as it is possible to filter the color of excreta inside the toilet when the inside of the toilet is viewed through the transparent hole.

Meanwhile, although the inside of the toilet can be checked only through the transparent hole filled with the transparent material, in the case in which the convex lens is added according to one exemplary embodiment of the present disclosure, the transparent hole may be configured as a small hole, and a residue inside the toilet can be accurately checked without viewing the entire residue inside the toilet.

Here, in the case of the first transparent hole 10 to which the convex lens 15 is added, since the first transparent hole 10 is for checking in detail whether a residue is present in the toilet, the first transparent hole 10 may be positioned at an upper end of a drain hole where a residue is most likely to be present.

Meanwhile, referring back to FIG. 5, like the first through-hole 10, the second transparent hole 20 according to one exemplary embodiment of the present disclosure is formed by penetrating the toilet cover 30, then filled with a material that is easily moldable and transparent, such as transparent acrylic and transparent polycarbonate, and includes a colored cellophane sheet 12 and the concave lens 25 therein. Here, like the colored cellophane sheet 12 of the first through-hole 10, the colored cellophane sheet 12 is for filtering color in order to reduce disgust in terms of sight in a case in which a residue, such as excreta or vomit, is present inside the toilet, and thus the colored cellophane sheet 12 may be provided to be attached onto the transparent material, inserted into a middle of the transparent material, or provided to be attached to a lower portion of the transparent material, or color may be added to the transparent material itself to form a colored transparent hole. That is, any configuration may be applied as long as it is possible to filter the color of excreta inside the toilet when the inside of the toilet is viewed through the transparent hole.

Meanwhile, although the inside of the toilet can be checked only through the transparent hole filled with the transparent material, in the case in which the concave lens 25 is added according to one exemplary embodiment of the present disclosure, the transparent hole may be configured as a small hole, and the overall situation of a residue inside the toilet can be checked without viewing the entire residue inside the toilet.

Here, in the case of the second transparent hole 20 to which the concave lens 25 is added, since the second transparent hole 20 is for checking a residue in the entire toilet, the second transparent hole 20 may be positioned at a middle of the toilet cover 30 where it is possible to view the entire toilet.

According to the present disclosure described above, by the first transparent hole 10 and the second transparent hole 20, there is an advantageous effect that whether a residue is present in the toilet can be checked through the transparent holes of the toilet cover without opening the toilet cover or performing an additional operation.

Also, according to the present disclosure described above, by a colored transparent hole coated with a specific color being formed in the toilet cover or a colored cellophane sheet being attached to a transparent hole of the toilet cover, there is an advantageous effect that a color of a residue present inside the toilet can be changed to reduce disgust towards seeing the corresponding residue.

Hereinafter, a toilet residue alarm apparatus according to one exemplary embodiment of the present disclosure will be described in more detail with reference to FIG. 6.

FIG. 6 is a block diagram of a toilet residue alarm apparatus according to one exemplary embodiment of the present disclosure.

Referring to FIG. 6, the toilet residue alarm apparatus according to one exemplary embodiment of the present disclosure includes the power switch 110, a power supply device 120, the approach sensor 130, a detection switch 140, a residue sensor 150, and an alarm device 160.

First, the power switch 110 may be configured as a push button switch or the like that is turned on while pressed, but the toilet residue alarm apparatus may be configured to exclude the power switch 110. That is, in a case in which the toilet residue alarm apparatus provided at the toilet cover according to one exemplary embodiment of the present disclosure is configured to always receive power from an indoor power terminal, the toilet residue alarm apparatus may be configured to detect an approach of a user at all times.

However, since the inside of the toilet can be visually checked immediately when the toilet cover is open, the toilet residue alarm apparatus according to the present disclosure presumes that the toilet cover is closed. The toilet residue alarm apparatus being configured to operate while the toilet cover is closed is also desirable in terms of reducing the power consumption.

Therefore, in one exemplary embodiment of the present disclosure, by the power switch 110 being configured as a push button switch and provided on an inner side of a leading end of the toilet cover 30, the power switch 110 provided at the leading end of the toilet cover 30 is configured to be turned on only while in contact with the toilet seat 40 and pressed due to the toilet cover 30 being closed.

While being turned on as above, the power switch 110 applies a turn-on signal to the power supply device 120 so that the power supply device 120 supplies power to the approach sensor 130.

The power supply device 120 may be configured to always receive power from an indoor power terminal. In this case, since a permissible range of power consumption is high, there is an advantageous effect that a degree of freedom in designing additional components of the toilet residue alarm apparatus according to an exemplary embodiment of the present disclosure is high.

Meanwhile, the power supply device 120 may be configured as a portable power source such as a battery. In this case, since the wiring of the toilet residue alarm apparatus according to an exemplary embodiment of the present disclosure is simplified, and the indoor power terminal becomes unnecessary, there is an advantageous effect that, due to less space constraints, a degree of freedom of installation increases.

Meanwhile, in a case in which the toilet residue alarm apparatus according to an exemplary embodiment of the present disclosure is applied to outdoor toilets where power supply is not smooth and management, such as frequently replacing the battery, is not easy, the toilet residue alarm apparatus may be configured to use power of power generation equipment such as a solar panel.

For example, the approach sensor 130 is configured as an infrared sensor or the like and is provided at a leading end of the toilet seat 40 to detect an approach of a person from the front of the toilet and, when an approach of a person is detected, generate a detection signal and apply the generated detection signal to the detection switch 140. Here, the detection signal applied from the approach sensor 130 may serve as a turn-on signal of the detection switch 140 and turn on the detection switch 140, thus allowing power to be supplied from the power supply device 120 to the residue sensor 150.

The detection switch 140 is configured as a transistor or the like and is turned on due to the detection signal from the approach sensor 130 to supply power from the power supply device 120 to the residue sensor 150.

The residue sensor 150 may include the light source 152 and the light receiver 154 and may be configured as a type of turbidity sensor. For example, as illustrated in FIG. 4, the light source 152 that consists of two light-emitting diodes (LEDs) is provided at an inner side of the toilet cover 30, and the light receiver 154 is provided in between the two LEDs so that a secretion detection signal is generated according to a signal indicating that light emitted from the light source 152 is reflected from water or a residue in the toilet and then received by the light receiver 154. That is, in a case in which there are no secretions, the entire light emitted from the light source 152 is reflected from a surface of water in the toilet such that the amount of received light is large, but in a case in which secretions are present, some of the light emitted from the light source 152 is absorbed by the secretions such that the amount of received light decreases. Therefore, when the amount of light received by the light receiver 154 is less than or equal to a predetermined amount, the residue sensor 150 detects that a residue is present in the toilet and generates a residue detection signal. Here, the toilet residue alarm apparatus may further include a signal amplifier (not illustrated) as necessary, and the residue detection signal serves as a switching signal that turns on the alarm device 160.

The alarm device 160 is configured as at least any one of a visual alarm device such as an LED and an aural alarm device such as a buzzer. When the residue detection signal is applied from the residue sensor 150 to the alarm device 160, the alarm device 160 is turned on and emits light and/or generates an alarm sound.

In the present disclosure, an example in which the toilet cover is implemented using a simple circuit such as an LED, a buzzer, an infrared sensor, or a transistor in order to implement the toilet cover with a low-cost, simple configuration has been described. However, according to the requested quality, the toilet cover may be implemented with a configuration that includes a programmed system controller, which can implement the toilet cover by further reflecting requests from a user, and provides guidance text through a display device and provides a voice alarm according to a detected signal.

According to the present disclosure described above, there is an advantageous effect that, in a case in which a residue is present inside the toilet, by detecting the residue and providing an alarm to a user visually and/or aurally, the user can be aware of the disgusting matter inside the toilet without directly checking the inside of the toilet.

The above-given description of the embodiments is provided to allow anyone of ordinary skill in the art to which the present disclosure pertains to use or carry out the present disclosure. Various modifications of the embodiments will be apparent to those of ordinary skill in the art of the present disclosure.

Accordingly, the present disclosure is not limited to the embodiments proposed herein and should be construed to have the widest possible range that is consistent with the principles and novel features proposed herein. Also, the term "exemplary" is used herein to signify that the embodiments are provided as examples and provided for illustrative purposes only.

Therefore, the exemplary embodiments illustrated and described herein may be changed, altered, and modified in various ways without departing from the spirit and scope of the present disclosure, especially, the essential characteristics thereof. That is, since details disclosed and described herein are only for the description of the appended claims, and the scope of the present disclosure is not limited thereto, the scope of the present disclosure can be specified only by the appended claims.

The invention claimed is:

1. A toilet cover allowing an inside of a toilet, which includes a toilet seat and the toilet cover, to be checked and having one end fixed to an upper portion of the toilet by a steel hinge to be able to be opened and closed by rotation, the toilet cover comprising:

at least one transparent hole of a first transparent hole which is a through-hole with a predetermined diameter that is filled with a transparent material and includes a convex lens therein and a second transparent hole which is a through-hole with a predetermined diameter that is filled with a transparent material and includes a concave lens therein; and a colored cellophane sheet configured to cover the at least one transparent hole.

2. The toilet cover of claim 1, wherein the first transparent hole is positioned at a vertical upper end of a drain hole of the toilet, and the second transparent hole is positioned at a center of the toilet cover.

3. The toilet cover of claim 1, wherein the toilet cover allowing the inside of the toilet to be checked uses, in place of the colored cellophane sheet, a colored transparent material obtained by dyeing the transparent material a predetermined color.

4. A toilet residue alarm apparatus provided at a toilet cover to alert the presence of a residue in a toilet, the toilet residue alarm apparatus comprising:

an approach sensor configured to detect an approach of a person;

a residue sensor configured to, in response to the approach of the person being detected by the approach sensor, detect whether a residue is present in the toilet;

an alarm device configured to, in response to the residue being detected by the residue sensor, alert the presence of the residue by turning on light or generating an alarm sound; and a power switch provided at a leading end of the toilet cover to allow the toilet residue alarm apparatus to operate only in a state in which the toilet cover is placed on and closing the toilet.

5. The toilet residue alarm apparatus of claim 4, wherein the power switch is a push button switch.

6. The toilet residue alarm apparatus of claim 4, further comprising:

a power supply device configured to supply power in response to the power switch being turned on; and a detection switch configured to block power supplied from the power supply device to the residue sensor and be turned on and supply the power from the power supply device to the residue sensor only in a case in which an approach detection signal is generated by the approach sensor.

* * * * *